US006695164B1

(12) United States Patent
Chayer

(10) Patent No.: US 6,695,164 B1
(45) Date of Patent: Feb. 24, 2004

(54) STORAGE SYSTEMS AND METHODS FOR PAINT ROLLER SLEEVES

(76) Inventor: Steven A. Chayer, 4445 S. 168th St., Seatac, WA (US) 98188

( * ) Notice: Subject to any disclaimer, the term of this patent is extended or adjusted under 35 U.S.C. 154(b) by 0 days.

(21) Appl. No.: 10/081,335

(22) Filed: Feb. 20, 2002

(51) Int. Cl.[7] ..... B65D 25/00

(52) U.S. Cl. ..... 220/735; 220/736; 206/15.2; 206/361; 206/209

(58) Field of Search ..... 206/15.2, 15.3, 206/207, 209, 361, 362, 362.1; 220/736, 735, 212; 15/257.05, 257.06

(56) References Cited

U.S. PATENT DOCUMENTS

| | | | | |
|---|---|---|---|---|
| 501,282 | A | | 7/1893 | Leggett |
| 1,022,074 | A | | 4/1912 | Graham |
| 1,254,714 | A | | 1/1918 | McCombs |
| 1,682,571 | A | | 8/1928 | Horan |
| 1,687,179 | A | | 10/1928 | Peterson |
| 1,943,639 | A | | 1/1934 | Thatcher |
| 2,175,735 | A | | 10/1939 | Banks |
| 2,533,355 | A | | 12/1950 | Comfort |
| 2,654,504 | A | | 10/1953 | Hyams |
| 2,704,931 | A | | 3/1955 | Zelkowitz |
| 2,766,603 | A | | 10/1956 | Zelkowitz |
| 2,794,264 | A | | 6/1957 | Scholtka |
| 2,831,488 | A | | 4/1958 | Anderson |
| 3,085,583 | A | | 4/1963 | Siek |
| 3,133,669 | A | | 5/1964 | Scholtz |
| 3,269,588 | A | | 8/1966 | Ruekberg |
| 3,289,881 | A | | 12/1966 | Ganung |
| 3,406,812 | A | | 10/1968 | Henry |
| 3,421,170 | A | | 1/1969 | Thomas, Jr. |
| 3,421,527 | A | | 1/1969 | Dettman |
| 3,529,744 | A | | 9/1970 | Johnson et al. |
| 3,820,552 | A | | 6/1974 | Lang et al. |
| 3,918,582 | A | | 11/1975 | Wallace |
| 4,116,332 | A | | 9/1978 | Hartley |
| 4,155,230 | A | | 5/1979 | Lacher, Jr. |
| 4,334,416 | A | | 6/1982 | Turano |
| 4,360,119 | A | | 11/1982 | Olivo |
| 4,377,175 | A | | 3/1983 | Fritz |
| 4,380,478 | A | | 4/1983 | Cooney |
| 4,533,044 | A | | 8/1985 | Ban |
| 4,738,358 | A | | 4/1988 | Kehl |
| 4,766,755 | A | | 8/1988 | Allen |
| 4,903,869 | A | * | 2/1990 | McKenna ..... 222/449 |
| 4,957,127 | A | | 9/1990 | Kostopoulos |
| 5,301,799 | A | | 4/1994 | Gurba, Jr. |
| 5,314,061 | A | | 5/1994 | Bedrossian |
| 5,341,969 | A | | 8/1994 | Accardo et al. |
| 5,540,363 | A | | 7/1996 | Wilson |
| 5,645,091 | A | | 7/1997 | Hoeft |
| 5,709,301 | A | | 1/1998 | Couch et al. |
| 5,799,813 | A | | 9/1998 | Letica |
| 5,806,704 | A | | 9/1998 | Jamison |

(List continued on next page.)

FOREIGN PATENT DOCUMENTS

| | | |
|---|---|---|
| JP | 3-69438 | * 10/1989 |

*Primary Examiner*—David T. Fidei
(74) *Attorney, Agent, or Firm*—Michael R. Schacht; Schacht Law Office, Inc.

(57) ABSTRACT

A storage system for paint roller sleeves defining a core cavity. The storage system comprises a bucket member, a lid member, and a roller projection. The bucket member defines a bucket chamber and an upper edge, and paint is arranged within the bucket chamber. The lid member defines an edge wall adapted to engage the upper edge of the bucket member. The roller projection extends into the bucket chamber to support the paint roller sleeve within the bucket chamber. The roller projection defines at least one roller surface sized and dimensioned to engage the core cavity of the paint roller sleeve. The lid member seals the bucket chamber and thereby inhibits drying of the paint stored within the bucket chamber, including any paint on the roller sleeve suspended therein by the roller projection.

27 Claims, 4 Drawing Sheets

U.S. PATENT DOCUMENTS

| | | | |
|---|---|---|---|
| 5,853,157 | A | 12/1998 | O-Donnell |
| 5,992,617 | A | 11/1999 | Couch et al. |
| 6,000,574 | A | 12/1999 | Portillo |
| 6,041,919 | A | 3/2000 | Adams |
| 6,102,235 | A | 8/2000 | Stern et al. |
| 6,213,329 | B1 | 4/2001 | Dobson |
| 6,250,494 | B1 | 6/2001 | Diamond |
| 6,273,291 | B1 | 8/2001 | Conti |

* cited by examiner

STORAGE SYSTEMS AND METHODS FOR PAINT ROLLER SLEEVES

TECHNICAL FIELD

The present invention relates to storage systems and methods for paint roller sleeves and, in particular, to such systems and methods that allow a paint roller sleeve to be stored in the same container in which the paint is stored.

BACKGROUND OF THE INVENTION

Painters often use paint roller assemblies to apply paint to a surface. A paint roller assembly typically comprises a roller sleeve supported by a roller handle assembly. The roller handle assembly comprises a handle member and a roller cage. The roller cage is supported by the handle member for rotation about a roller axis. The roller sleeve is detachably attached to the roller cage. During use, the user grasps the handle member to roll the roller sleeve about the roller axis first in paint (usually in a tray) and then onto the surface to be coated.

Conventionally, paint roller sleeves are considered disposable. However, the paint roller sleeves are often cleaned and reused several times before eventually being discarded. If the entire paint roller assembly is cleaned so that the roller sleeve may be reused, as much paint as possible is first removed from the roller sleeve. The roller sleeve and roller handle assembly are then rinsed in the appropriate solvent.

The steps of removing paint from the roller sleeve and rinsing the roller sleeve with a solvent can be messy and time consuming. The need thus exists for systems and methods that facilitate the re-use of roller sleeves.

SUMMARY OF THE INVENTION

The present invention is a storage system for paint roller sleeves defining a core cavity. The storage system comprises a bucket member, a lid member, and a roller projection. The bucket member defines a bucket chamber and an upper edge, and paint is arranged within the bucket chamber. The lid member defines an edge wall adapted to engage the upper edge of the bucket member. The roller projection extends into the bucket chamber to support the paint roller sleeve within the bucket chamber. The roller projection defines at least one roller surface sized and dimensioned to engage the core cavity of the paint roller sleeve. The lid member seals the bucket chamber and thereby inhibits drying of the paint stored within the bucket chamber, including any paint on the roller sleeve suspended therein by the roller projection.

DETAILED DESCRIPTION OF THE PREFERRED EMBODIMENTS

Figure 1:
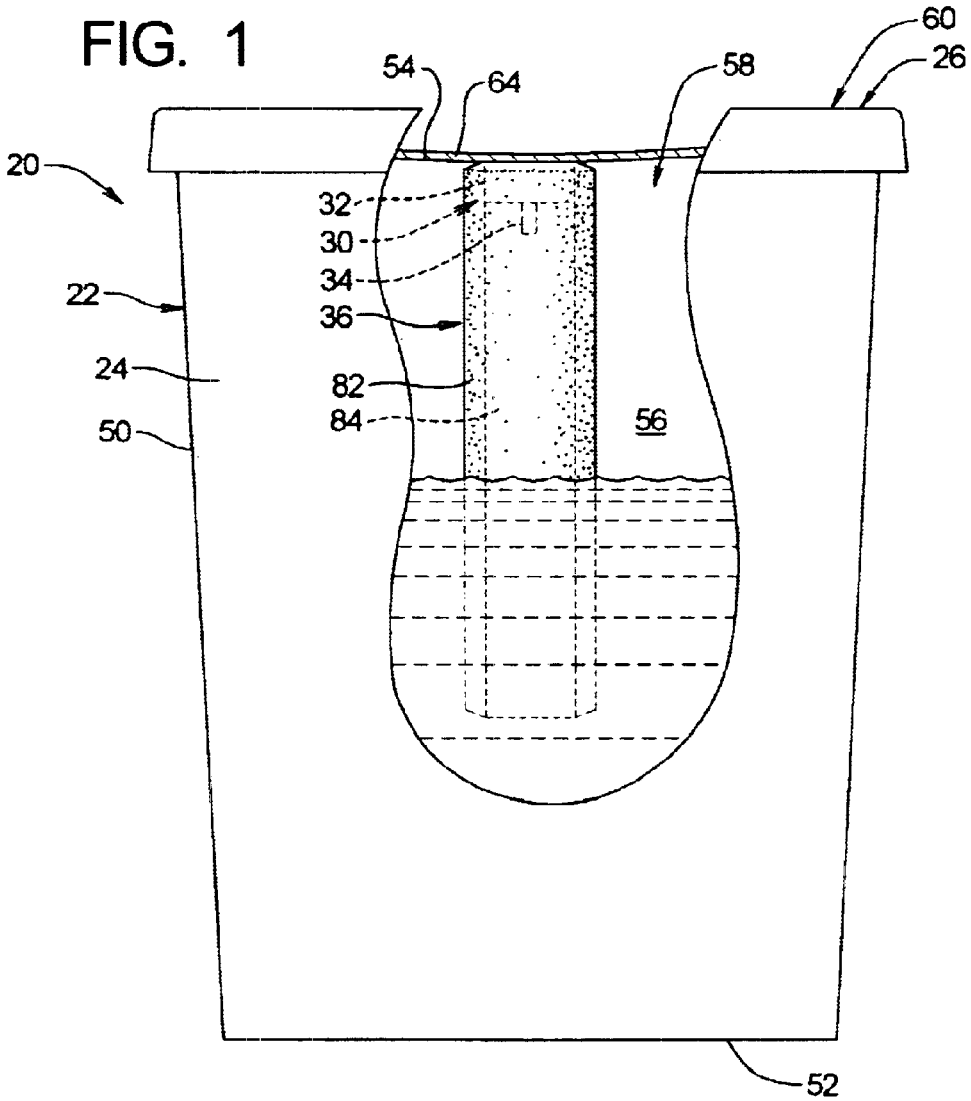
FIG. 1 is a front elevation partial cutaway view depicting a roller storage system of the present invention.
Figure 2:
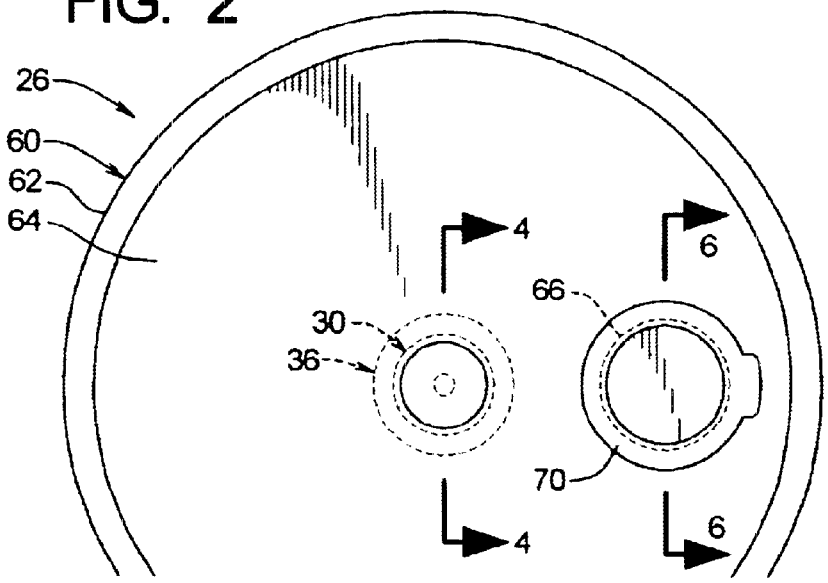
FIG. 2 is a top plan view depicting lid assembly of the roller storage system depicted in FIG. 20.

Referring initially depicted in FIG. 1, depicted at 20 therein is a roller storage system constructed in accordance with, and embodying, the principles of the present invention. The exemplary roller storage system 20 comprises a bucket assembly 22 comprising a bucket 24 and a lid 26.

A roller projection 30 defining first and second roller surfaces 32 and 34 is arranged within the bucket assembly 22. The roller surfaces 32 and 34 of the roller projection 30 are each adapted to secure one type or form factor of a paint roller sleeve 36 within the bucket assembly 22.

Figure 3:
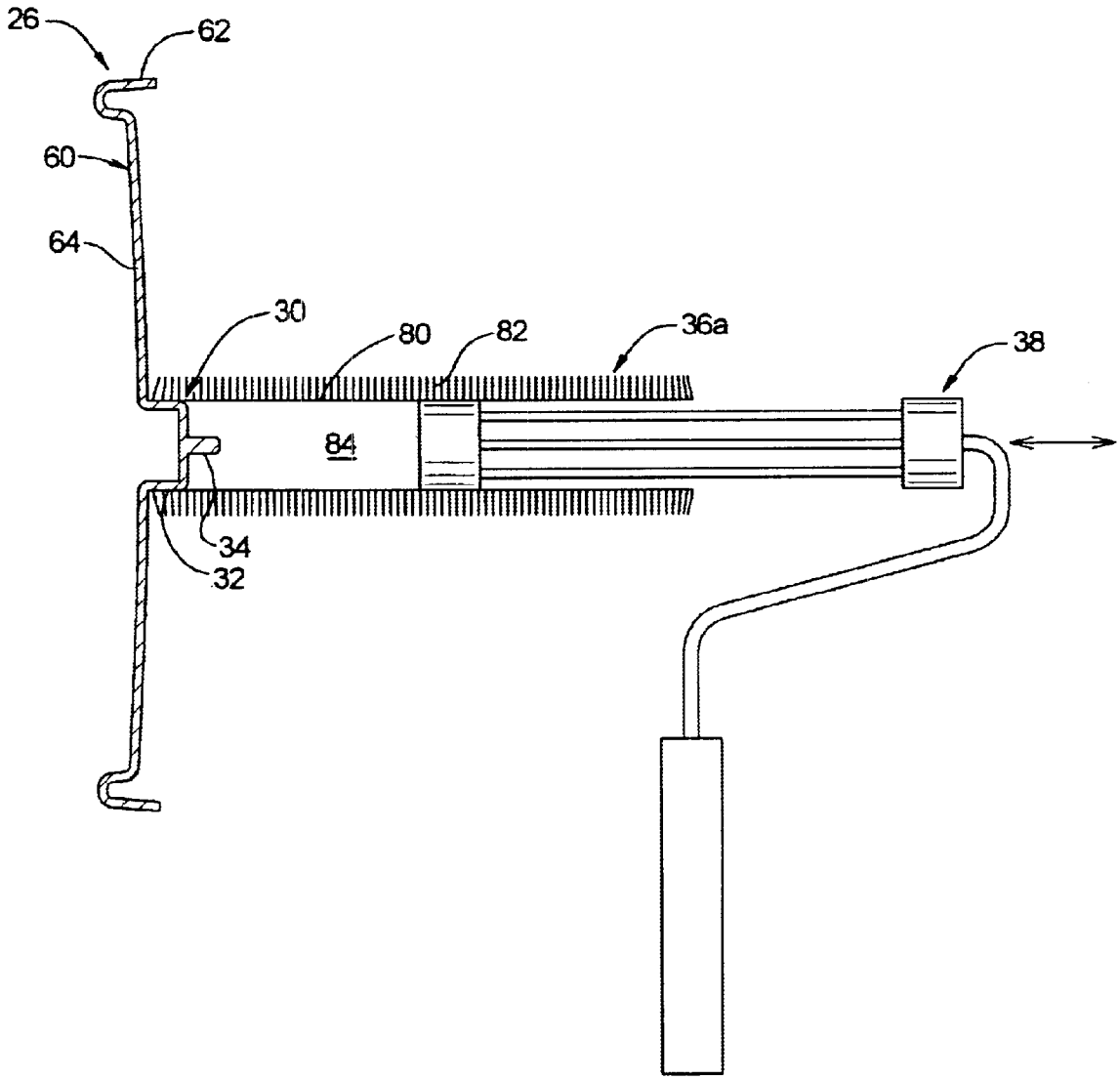
FIG. 3 is a side elevation view depicting the engagement of one type of paint roller sleeve onto a roller projection of the roller storage system of FIG. 1.

The roller projection 30 allows a painter to store roller sleeves 36 within the bucket assembly 22 between uses. In particular, the roller sleeve 36 is conventionally mounted on a handle assembly 38 as generally described above. The roller sleeve 36 may be transferred between the handle assembly 38 and either of the roller surfaces 32 or 34 of the roller projection 30; for example, FIG. 3 illustrates the roller sleeve 36 being transferred between the handle assembly 38 and the first roller surface 32 of the roller projection 30.

A primary benefit of the roller projection 30 of the present invention is that the painter need not clean or even remove excess paint from the roller sleeve 36 between uses. The painter may simply transfer the roller sleeve 36 directly from the handle assembly 38 to the roller projection 30 and seal the bucket assembly 22. The next time the roller sleeve 36 is to be used, the painter simply opens the bucket assembly 22 and transfers the roller sleeve 36 back onto the handle assembly 38. Because the bucket assembly 22 is substantially sealed, this process can be repeated without the paint drying on the roller sleeve 36. The roller storage system 20 thus allows the roller sleeve 36 to be easily removed while eliminating most if not all of the cleaning process associated with such reuse.

The roller projection 30 may be formed at any location that allows easy or convenient transfer of the roller sleeve 36 to the roller projection 30. In the exemplary roller storage system 20, the roller projection 30 is integrally formed with the lid 26. Accordingly, when the roller sleeve 36 receives the roller projection 30, the roller sleeve 36 is temporarily secured to the lid 26. The roller projection 30 extends from the lid 26 such that, when the lid 26 is secured to the bucket 24 to define the bucket assembly 22, the roller sleeve 36 is enclosed within the bucket assembly 22.

The formation of the roller projection 30 on the lid 26, while not required to practice the present invention in its broadest form, simplifies the task of transferring the roller sleeve 36 from the handle assembly 38 to the roller projection 30. Conventionally, the lid 26 is flat and thus does not restrict access to the roller projection 30. The lid 26 is removed from the bucket 24 and supported with roller projection 30 exposed. The transfer between the projection 30 and handle assembly 38 is then performed.

Figure 4:
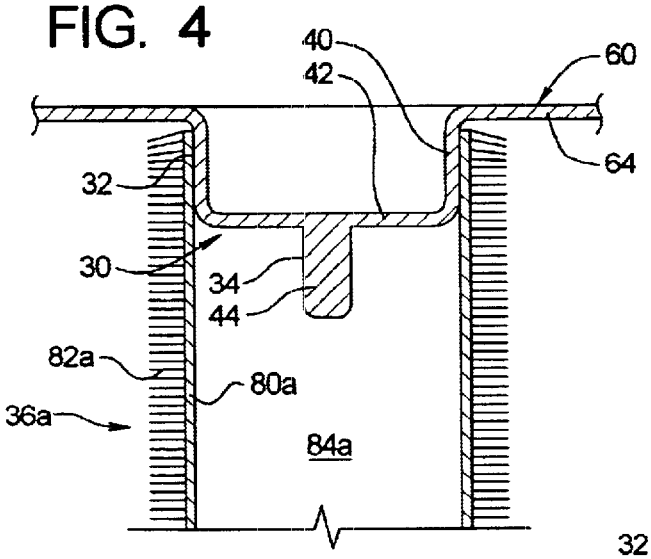
FIG. 4 is a partial cutaway view taken along lines 4—4 in FIG. 2 depicting the attachment of the first type of paint roller sleeve to the roller projection of the roller storage system of FIG. 1.
Figure 5:
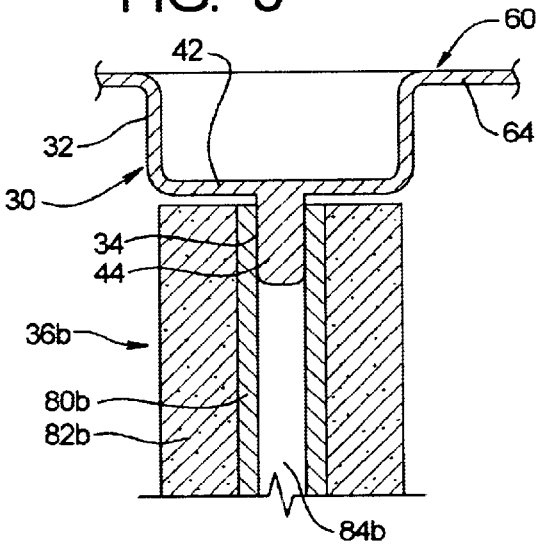
FIG. 5 is a partial cutaway view taken along the same lines as FIG. 4 depicting the attachment of a second type of paint roller sleeve to the roller projection of the roller storage system of FIG. 1.

Referring now to FIGS. 4 and 5, it can be seen that the roller sleeves 36 are typically configured in different types each having a unique form factor. FIG. 4 depicts a roller sleeve 36*a* of a first type, while FIG. 5 depicts a roller sleeve 36*b* of a second type.

As discussed above, the roller projection 30 defines first and second roller surfaces 32 and 34. The first type of roller sleeve 36*a* is adapted to receive and be supported by the first roller surface 32, while the second type of roller sleeve 36*b* is adapted to receive and be supported by the second roller surface 34.

The exemplary roller projection 30 defines an engaging wall 40, a transition wall 42, and an engaging projection 44. The engaging wall 40 defines the first roller surface 32. The engaging projection 44 defines the second roller surface 34.

The engaging wall 40 and engaging projection 44 may be cylindrical resulting in cylindrical roller surfaces 32 and 34. However, a preferred embodiment of the present invention is to make the engaging wall 40 and engaging projection 44 slightly tapered such that the surfaces 32 and 34 are conical. As the roller sleeves 36 are pressed onto the surfaces 32 or 34, the friction created by the conical surfaces 32 and 34 will gradually increase.

In addition, the conical wall 40 and projection 44 can be sized and dimensioned to allow the lids 26 to be stacked one on top of each other in a nested arrangement. In this case, the engaging projection 44 should be made hollow (see, e.g., FIGS. 9 and 10), and the wall thicknesses, wall inner surface dimensions, and roller surface dimensions must be calculated to allow the nesting of lids with the roller projection of one received inside the roller projection of the other.

The first roller surface 32 defined by the engaging wall 40 has a larger diameter than the second roller surface 34 defined by the engaging projection 44. The exemplary transition wall 42 is generally disc shaped and supports the engaging projection 44 from the engaging wall 40.

In the exemplary roller projection 30, the first and second roller surfaces 32 and 34 are substantially coaxially aligned. This geometry is aesthetically pleasing and lends itself to the type of molding techniques used to manufacture the bucket assembly 22, but the present invention may be embodied in roller projections having different arrangements of the roller surfaces 32 and 34.

With the foregoing basic understanding of the present invention in mind, the exemplary roller storage system 20 will now be described in further detail.

The bucket 24 is conventional and defines a generally cylindrical side wall 50, a substantially circular bottom wall 52, and an annular upper edge 54. The walls 50 and 52 of the bucket 24 define a bucket chamber 56 with an upper opening 58.

The lid assembly comprises a lid member 60 having an edge wall 62 and a top wall 64. A tint opening 66 is formed in the top wall 64 of the lid member 60. The exemplary lid 26 further comprises a tint cap 70 that is fastened to the top wall over the tint opening 66.

The edge wall 62 of the lid member 60 is adapted to engage the upper edge 54 of the bucket side wall 50 to cover the upper opening 58. With the tint cap secured to the lid member 60 and the lid member 60 secured to the bucket 24, the bucket chamber 56 is substantially airtight. As generally discussed above, the airtight bucket chamber 56 inhibits drying of paint within the bucket chamber 56.

Accordingly, when the roller sleeve 36 is attached to the roller projection 30 and the lid 26 is secured to the bucket 24, the roller sleeve 36 is also sealed within the bucket chamber 56. Paint within the chamber 56, including any wet paint on the roller sleeve 36, will not dry appreciably as long as the bucket chamber 56 remains sealed.

Referring for a moment back to FIGS. 4 and 5, it can be seen that the roller members 36*a* and 36*b* each comprise a core 80*a, b* surrounded by nap material 82*a, b*. The cores 80*a* and 80*b* define core cavities 84*a* and 84*b*. The core cavities 84*a* and 84*b* are substantially cylindrical. The first and second roller surfaces 32 and 34 are sized and dimensioned to be snugly received within the core cavities 84*a* and 84*b* such that a friction fit is created that secures the roller sleeve 36 to the roller projection 30 under most normal conditions.

In addition, for certain roller sleeves 36, air will be trapped within the core cavities 84 when the sleeves 36 are attached to the lid 26 and the lid 26 attached to the bucket 24. This trapped air might prevent the paint from contaminating the interior surfaces of the sleeves 36, which could simplify the process of transferring a stored sleeve 36 back onto the handle assembly 38.

While the exemplary roller surfaces 32 and 34 engage the cores 80*a* and 80*b* using a friction fit, one or both of the surfaces 32, 34 or cores 80*a, b* can be altered to include, for example, an adhesive, textured surface, or detent-like projection adapted to enhance the attachment of the roller sleeve 36 onto the roller projection 30.

Typically, the bucket member 24 and lid member 60 are made of molded plastic. The roller projection 30 as described herein may easily be integrally molded into the lid member 60, and the cost of the roller projection would not significantly increase the costs of manufacturing the lid member 60.

Figure 9:
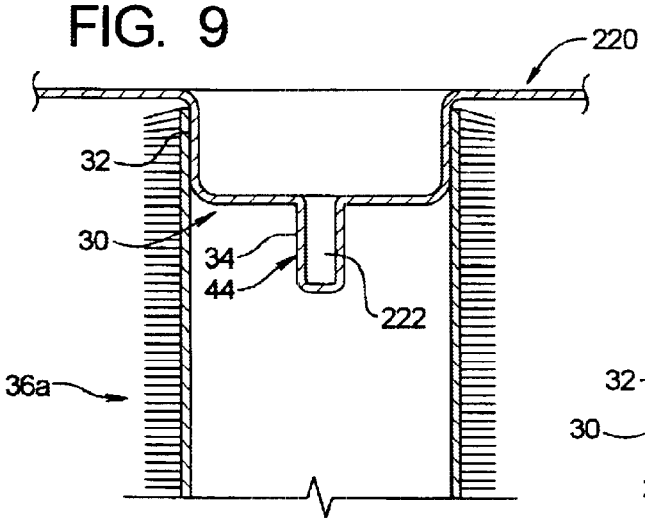
FIG. 9 is a partial cutaway view depicting the attachment of the first type of paint roller sleeve to a roller projection formed on a metal lid member.
Figure 10:
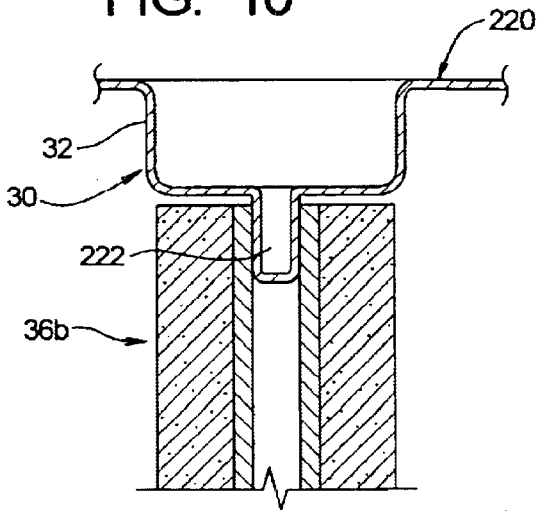
FIG. 10 is a partial cutaway view depicting the attachment of a second type of paint roller sleeve to the roller projection of the roller storage system of FIG. 9.

Referring for a moment to FIGS. 9 and 10, these figures show that the roller projection 30 may also be formed in a lid member 60 made of metal. The lid member 30 made of metal is typically stamped out of a blank at the same time as the other features of the metal lid member; as with a plastic lid member, the roller projection 30 may be integrally formed on a metal lid member without appreciably increasing the costs of manufacturing the lid member 60.

Figure 6:
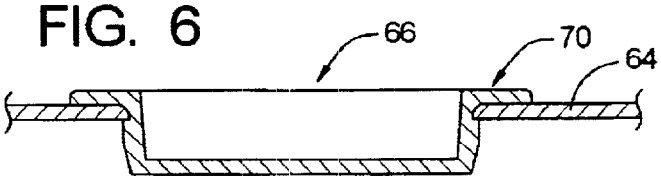
FIG. 6 is a partial section view taken along lines 6—6 in FIG. 2.
Figure 7:
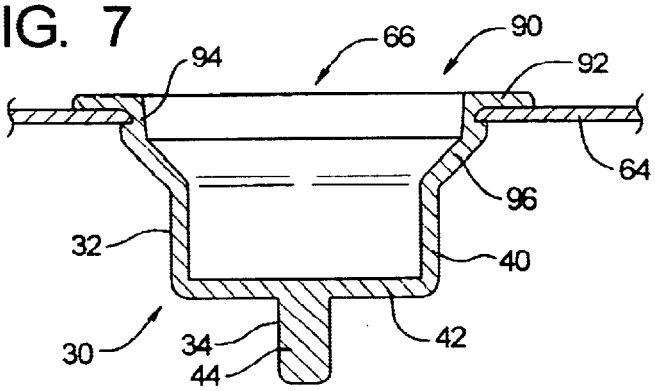
FIG. 7 is a partial cutaway view taken along the same lines as FIG. 6 but depicting an optional roller projection cap of another embodiment of the present invention.

Referring now to FIG. 7, depicted therein is another embodiment of the present invention. In particular, FIG. 7 illustrates that the tint cap 70 (FIG. 6) conventionally used by paint manufacturer's to cover the tint opening 66 may be removed and replaced by a roller projection cap 90. In this embodiment, the roller projection 30 is preferably formed on the roller projection cap 90 instead of on the lid member.

The exemplary roller projection cap 90 comprises, in addition to the roller projection 30, a top flange 92, a locking wall 94, and a bridge wall 96. The top flange 92 engages an upper surface of the lid member top wall 64. The locking wall 94 is sized and dimensioned to extend around a portion of the top wall 64 defining the tint opening 66. A substantially air-tight seal is formed around the tint opening 66 by the engagement of the flange 92 and locking wall 94 with the lid member top wall 64.

The bridge wall 96 is sized and dimensioned to extend between the tint opening 66 and the roller projection 30. In particular, the cross-sectional area of engaging wall 40 of the roller projection 30 is typically different from the cross-sectional area of the tint opening 66. With conventional tint openings 66 and roller sleeves 36 currently available in the market, the cross-sectional area of the engaging wall 40 is smaller than the cross-sectional are of the tint opening 66. Accordingly, the exemplary bridge wall 96 is conical and has a diameter adjacent to the locking wall 94 that is larger than its diameter adjacent to the engaging wall 40. The present invention may, however, also be implemented using other bridge wall geometries.

As with the integrally formed roller projection 30 described above, the engaging wall 40 and engaging projection 44 of the roller projection cap 90 may be cylindrical, but a preferred embodiment of the present invention would be to make the engaging wall 40 and engaging projection 44 slightly tapered. Friction sufficient to fix the roller sleeves 36 relative to the cap 90 will be created by the conical surfaces 32 and 34. In addition, the conical wall 40 and projection 44 can be sized and dimensioned to allow the caps 90 be stacked one on top of each other in a nested arrangement. Again, the engaging projection 44 should be made hollow, and the wall thicknesses, wall inner surface dimensions, and roller surface dimensions must be calculated to allow the nesting of caps with the roller projection of one received inside the roller projection of the other.

The use of a roller projection cap 90 would allow the use of a conventional lid member without an integrally formed roller projection. The roller projection cap 90 thus presents different marketing and distribution options; rather than being marketed and distributed by the lid manufacturers, the roller projection cap 90 may be manufactured by another party and distributed to paint retail outlets where the tinting is performed. In all other respects, the roller projection cap 90 functions and is used in the same manner as a roller projection integrally formed with the lid member.

Figure 8:
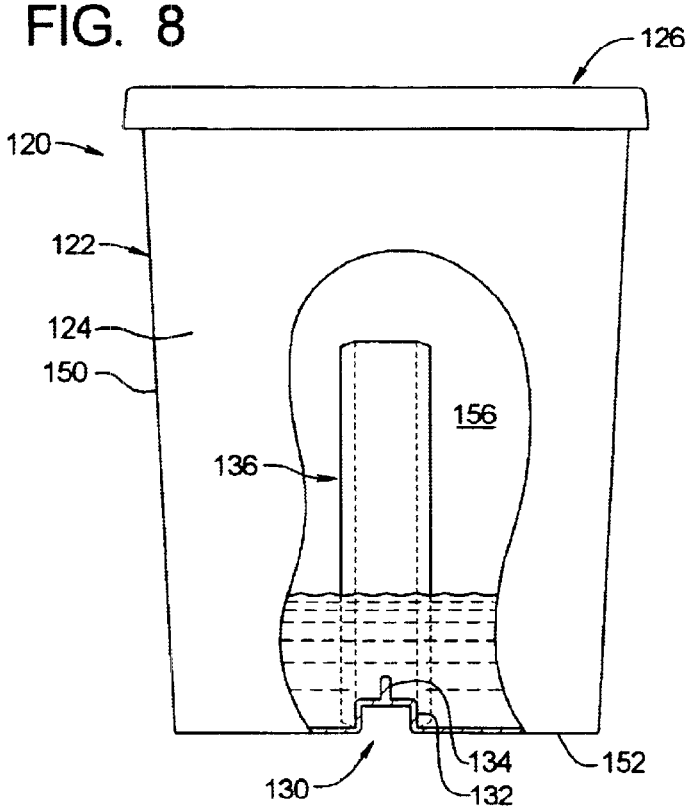
FIG. 8 is a front elevational and partial cutaway view depicting yet another embodiment of the present invention with a roller projection formed on the bucket number of the roller storage system depicted therein.

Referring now to FIG. 8, depicted therein is yet another embodiment 120 of a roller storage system constructed in accordance with principals of the present invention. The roller storage system 120 is similar to the storage system 20 described above in that it comprises a bucket assembly 122 comprising a bucket 124 and lid assembly 126. And, as with the system 120, the roller projection 130 defines first and second roller surfaces 132 and 134, each of which is sized and dimensioned to engage one type of a roller sleeve 136. However, in the roller storage system 120, the roller projection 130 is formed on the bucket member 124 rather than the lid assembly 126.

In particular, the bucket 124 is conventional in that it comprises a side wall 150 and a bottom wall 152. When combined with the lid assembly 126, the bucket member 124 defines a bucket chamber 156. The exemplary roller projection 130 extends upwardly into the bucket chamber 156 from the upper surface of the bottom wall 152.

The roller projection 130 is constructed and functions in substantially the same manner as the roller projection 130 described above. The side walls 150 of the bucket 124 may interfere with direct transfer of the roller sleeve 136 between the handle assembly and the roller projection 130, but this transfer should be easily accomplished by first removing the roller sleeve 136 from the handle assembly.

As an alternative, the roller projection 130 may also be formed on the side wall 150 of the bucket 124. In this case, the projection 130 would preferably be canted upwardly towards the upper opening defined by the bucket member 124 to facilitate direct transfer of the roller sleeve 136 between the handle assembly and the roller projection 130.

In addition, the roller projection 130 may be formed as part of a separate member supported within the bucket chamber 156 in a manner generally similar to the roller projection cap 90 described above. For example, the roller projection 130 may be formed on an annular member that engages the upper edge or inner surface of the side wall 150.

Further, as shown in FIGS. 9 and 10, the roller projection 30 may be formed on a lid 220 or projection cap made of metal. A metal lid 220 (or cap) will function in substantially the same manner as a plastic lid (or cap) as described above. A metal lid will typically be stamped from a flat piece of metal, and the engaging projection 44 of the roller projection 30 formed on a metal lid will typically be hollow as shown at 222 in FIGS. 9 and 10. Again, the roller projection 30 of a lid 220 preferably defines tapered roller surfaces 32 and 34 to allow the stacking of nested lids 220.

From the foregoing, it should be clear that the present invention may be embodied in forms other than those described above.

What is claimed is:

1. A storage system for paint roller sleeves defining a core cavity, the storage system comprising:

a bucket member defining a bucket chamber and an upper edge, where paint is arranged within the bucket chamber;

a lid member defining an edge wall, where the edge wall is adapted to engage the upper edge of the bucket member to seal the bucket chamber and thereby to inhibit drying of the paint within the bucket chamber; and a roller projection extending into the bucket chamber to support the paint roller sleeve within the bucket chamber, where the roller projection defines at least one roller surface sized and dimensioned to engage the core cavity of the paint roller sleeve; wherein the lid member defines a top wall; and the roller projection extends from the top wall of the lid member.

2. A storage system as recited in claim 1, in which the roller projection defines a plurality of roller surfaces, where each of the plurality of roller surfaces is sized and dimensioned to engage the core cavity of one type of paint roller sleeve.

3. A storage system as recited in claim 1, in which:

the bucket member defines a bottom wall; and the roller projection extends from the bottom wall of the bucket member.

4. A storage system as recited in claim 1, in which:

the lid member defines a top wall; and the roller projection extends from a projection member secured to the top wall of the lid member.

5. A storage system as recited in claim 1, in which:

a tint opening is formed in the top wall of the lid member; and the projection member covers the tint opening in the top wall of the lid member.

6. A storage system as recited in claim 1, in which the roller projection defines first and second roller surfaces, where the first and second roller surfaces are sized and dimensioned to engage the core cavities of first and second types of paint roller sleeves, respectively.

7. A storage system as recited in claim 3, in which the roller projection defines first and second roller surfaces, where the first and second roller surfaces are sized and dimensioned to engage the core cavities of first and second types of paint roller sleeves, respectively.

8. A storage system as recited in claim 4, in which the roller projection defines first and second roller surfaces, where the first and second roller surfaces are sized and dimensioned to engage the core cavities of first and second types of paint roller sleeves, respectively.

9. A storage system as recited in claim 5, in which the roller projection defines first and second roller surfaces, where the first and second roller surfaces are sized and dimensioned to engage the core cavities of first and second types of paint roller sleeves, respectively.

10. A method of storing paint roller sleeves defining a core cavity, the method comprising the steps of:

providing a bucket assembly comprising a bucket member defining a bucket chamber and an upper edge, and a lid member defining an edge wall;

disposing paint within the bucket chamber;

providing a roller projection defining at least one roller surface sized and dimensioned to engage the core cavity of the paint roller sleeve;

supporting the paint roller sleeve by displacing the paint roller sleeve such that the core cavity thereof receives the roller surface of the roller projection;

arranging the roller projection such that the roller projection and paint roller sleeve extend into the bucket;

arranging the lid member such that the edge wall of the lid member engages the upper edge of the bucket member to seal the bucket chamber and thereby inhibit drying of the paint within the bucket chamber; and forming the roller projection in a top wall of the lid member.

11. A method as recited in claim 10, further comprising the steps of forming a plurality of roller surfaces on the roller projection, where each of the plurality of roller surfaces is sized and dimensioned to engage the core cavity of one type of paint roller sleeve.

12. A method as recited in claim 10, further comprising the step of forming the roller projection in a bottom wall of the bucket member.

13. A method as recited in claim 10, further comprising the steps of:

forming the roller projection on a projection member; and securing the projection member to a top wall of the lid member.

14. A method as recited in claim 13, in which:

the step of providing the lid member comprises the step of forming a tint opening in the top wall of the lid member; and the step of securing the projection to the top wall of the lid member comprises the step of covering the tint opening in the top wall of the lid member.

15. A storage system for paint roller sleeves defining a core cavity, the storage system comprising:

a bucket member defining a bucket chamber and an upper edge, where paint is arranged within the bucket chamber;

a lid member defining an edge wall, where the edge wall is adapted to engage the upper edge of the bucket member to seal the bucket chamber and thereby to inhibit drying of the paint within the bucket chamber; and a roller projection extending into the bucket chamber to support the paint roller sleeve within the bucket chamber, where the roller projection defines a plurality of roller surfaces and each roller surface is sized and dimensioned to engage the core cavity of one type of paint roller sleeve.

16. A storage system as recited in claim 15, in which:

the lid member defines a top wall; and the roller projection is integrally formed with and extends from the top wall of the lid member.

17. A storage system as recited in claim 15, in which:

the lid member defines a top wall; and the roller projection extends from a projection member secured to the top wall of the lid member.

18. A storage system as recited in claim 17, in which:

a tint opening is formed in the top wall of the lid member; and the projection member covers the tint opening in the top wall of the lid member.

19. A storage system for paint roller sleeves defining a core cavity, the storage system comprising:

a bucket member defining a bucket chamber and an upper edge, where paint is arranged within the bucket chamber;

a lid member defining an edge wall, where the edge wall is adapted to engage the upper edge of the bucket member to seal the bucket chamber and thereby to inhibit drying of the paint within the bucket chamber; and a roller projection extending into the bucket chamber to support the paint roller sleeve within the bucket chamber, where the roller projection defines at least one roller surface sized and dimensioned to engage the core cavity of the paint roller sleeve; wherein the roller projection defines a plurality of roller surfaces, where each of the plurality of roller surfaces is sized and dimensioned to engage the core cavity of one type of paint roller sleeve.

20. A storage system for paint roller sleeves defining a core cavity, the storage system comprising:

a bucket member defining a bucket chamber and an upper edge, where paint is arranged within the bucket chamber;

a lid member defining an edge wall, where the edge wall is adapted to engage the upper edge of the bucket member to seal the bucket chamber and thereby to inhibit drying of the paint within the bucket chamber; and a roller projection extending into the bucket chamber to support the paint roller sleeve within the bucket chamber, where the roller projection defines at least one roller surface sized and dimensioned to engage the core cavity of the paint roller sleeve.

the lid member defines a top wall; and the roller projection extends from a projection member secured to the top wall of the lid member.

21. A storage system as recited in claim 20, in which:

a tint opening is formed in the top wall of the lid member; and the projection member covers the tint opening in the top wall of the lid member.

22. A storage system as recited in claim 20, in which the roller projection defines first and second roller surfaces, where the first and second roller surfaces are sized and dimensioned to engage the core cavities of first and second types of paint roller sleeves, respectively.

23. A storage system as recited in claim 21, in which the roller projection defines first and second roller surfaces, where the first and second roller surfaces are sized and dimensioned to engage the core cavities of first and second types of paint roller sleeves, respectively.

24. A storage system for paint roller sleeves defining a core cavity, the storage system comprising:

a bucket member defining a bucket chamber and an upper edge, where paint is arranged within the bucket chamber;

a lid member defining an edge wall, where the edge wall is adapted to engage the upper edge of the bucket member to seal the bucket chamber and thereby to inhibit drying of the paint within the bucket chamber; and a roller projection extending into the bucket chamber to support the paint roller sleeve within the bucket chamber, where the roller projection defines at least one roller surface sized and dimensioned to engage the core cavity of the paint roller sleeve; wherein the bucket member defines a bottom wall;

the roller projection extends from the bottom wall of the bucket member; and the roller projection defines first and second roller surfaces, where the first and second roller surfaces are sized and dimensioned to engage the core cavities of first and second types of paint roller sleeves, respectively.

25. A method of storing paint roller sleeves defining a core cavity, the method comprising the steps of:

providing a bucket assembly comprising a bucket member defining a bucket chamber and an upper edge, and a lid member defining an edge wall;

disposing paint within the bucket chamber;

providing a roller projection defining at least one roller surface sized and dimensioned to engage the core cavity of the paint roller sleeve;

supporting the paint roller sleeve by displacing the paint roller sleeve such that the core cavity thereof receives the roller surface of the roller projection;

arranging the roller projection such that the roller projection and paint roller sleeve extend into the bucket;

arranging the lid member such that the edge wall of the lid member engages the upper edge of the bucket member to seal the bucket chamber and thereby inhibit drying of the paint within the bucket chamber; and forming a plurality of roller surfaces on the roller projection, where each of the plurality of roller surfaces is sized and dimensioned to engage the core cavity of one type of paint roller sleeve.

26. A method of storing paint roller sleeves defining a core cavity, the method comprising the steps of:

providing a bucket assembly comprising a bucket member defining a bucket chamber and an upper edge, and a lid member defining an edge wall;

disposing paint within the bucket chamber;

providing a roller projection defining at least one roller surface sized and dimensioned to engage the core cavity of the paint roller sleeve;

supporting the paint roller sleeve by displacing the paint roller sleeve such that the core cavity thereof receives the roller surface of the roller projection;

arranging the roller projection such that the roller projection and paint roller sleeve extend into the bucket;

arranging the lid member such that the edge wall of the lid member engages the upper edge of the bucket member to seal the bucket chamber and thereby inhibit drying of the paint within the bucket chamber;

forming the roller projection on a projection member; and securing the projection member to a top wall of the lid member.

27. A method as recited in claim 26, in which:

the step of providing the lid member comprises the step of forming a tint opening in the top wall of the lid member; and the step of securing the projection to the top wall of the lid member comprises the step of covering the tint opening in the top wall of the lid member.

* * * * *